US005152524A

United States Patent [19]

Brown

[11] Patent Number: 5,152,524

[45] Date of Patent: Oct. 6, 1992

[54] GOLF ACCESSORY DEVICE

[76] Inventor: Stanley M. Brown, 122 Beechwood Dr., Piedmont, S.C. 29673

[21] Appl. No.: 503,661

[22] Filed: Apr. 3, 1990

[51] Int. Cl.[5] ..... A63B 57/00
[52] U.S. Cl. ..... 273/32 B
[58] Field of Search ..... 273/32 B, 32 A, 33; 294/49

[56] References Cited

U.S. PATENT DOCUMENTS

| | | | |
|---|---|---|---|
| 3,226,149 | 12/1965 | McJohnson | 294/49 |
| 4,007,928 | 2/1977 | Doubt | 273/32 A |
| 4,627,621 | 12/1986 | Tate | 273/32 B |
| 4,832,338 | 5/1989 | Magazzi | 273/32 A |
| 4,838,285 | 6/1989 | Petrone | 273/32 B |

FOREIGN PATENT DOCUMENTS

| | | | |
|---|---|---|---|
| 819016 | 10/1951 | Fed. Rep. of Germany | 294/49 |

*Primary Examiner*—Theatrice Brown

[57] ABSTRACT

A golf accessory device (A) includes a pair of lateral arms (10, 12) which extend laterally beyond a main body (C) for supporting grips (20) of a golf club handle above the ground. Inclined planar grip supporting surfaces (16) are provided for frictionally retaining the golf grip. Prongs (D) provide a stable anchor into the ground for the device and also a divot tool. A bore (40) formed in the free ends of the lateral arms provides a carrier for golf tees (44) and a bore (46) secures a ball marker (50). A simple compact device is provided which may be conveniently carried and used by a golfer for providing multiple functions.

14 Claims, 1 Drawing Sheet

GOLF ACCESSORY DEVICE

BACKGROUND OF THE INVENTION

The invention relates to the game of golf, and more particularly, to an accessory device for organizing and implementing various secondary functions which accommodate the game.

One of the problems associated with golf is that a player beginning with a tee time in the early morning typically encounters moisture on the ground. A player may carry two or three clubs with him which, for example, at the green requires that the player lay the clubs on the ground. In the early morning hours, the dew or moisture on the ground causes the handle grips of the clubs to become very wet. Not only do the grips become wet, but the player's hands or glove become wet. This can cause the golfer to lose his grip over the next club as well as experience the general discomfort from the wetness. Numerous devices have been proposed to overcome this problem by providing a device which will support the grip of a club above the ground when it is laid on the ground, for example, as shown in U.S. Pat. No. 4,063,731. Another problem encountered by golfers is the organization of the various accessory implements which are used in the game, such as tees, ball markers, and divot repair tools so that they may be readily found when needed. Various devices have been proposed for organizing these implements such as shown in U.S. Pat. Nos. 4,736,877, 4,535,987, and 4,151,937. However, these devices are relatively bulky and do not lend themselves to being readily carried and used by a golfer. The prior devices have not provided a suitable accessory device for supporting one or more golf clubs above the ground to prevent wetting, nor a device which is simple and compact so as to be desirable to a golfer for use.

Accordingly, an important object of the present invention is to provide a golf accessory device which will support a plurality of golf clubs above the ground to prevent the grips from becoming wet.

Another object of the present invention is to provide a golf accessory device for combining several golfing functions into a single simple device which can be easily utilized and carried by a golfer.

Another important object of the present invention is to provide a combination golf accessory device which may support a plurality of golf clubs above the ground, and organize a number of implements used in the golf game in a single practical device which can be easily used and carried by the golfer.

SUMMARY OF THE INVENTION

The above objectives are accomplished according to the invention by providing a golf accessory device which comprises a "T" body with a base and a pair of lateral arms which are carried by an upper portion of the base extending outwardly past the body for supporting grips of golf club handles above the ground. A grip supporting surface on each of the lateral arms frictionally engages the grip of the golf clubs. A pair of spaced prongs depend from a lower portion of the body for aligning the body in an upright position and provides a stable anchor in the ground for supporting the golf club grips above the ground. The first and second arms include an inclined planar support surface which provides a surface substantially parallel to a shaft of the golf club for frictional retention of the grip. A concave surface is formed between first and second lateral arms for holding a cigarette and like round article. The main body comprises a contoured handle which tapers outwardly towards the base which is engaged to push the prongs into the ground. The contoured handle is defined by the "T"-shaped lateral arms and inwardly curved surfaces which facilitate insertion of the prongs into the ground. The base projects laterally with respect to the prongs to provide a widened, stable base surface which contacts the ground with the prongs inserted in the ground.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
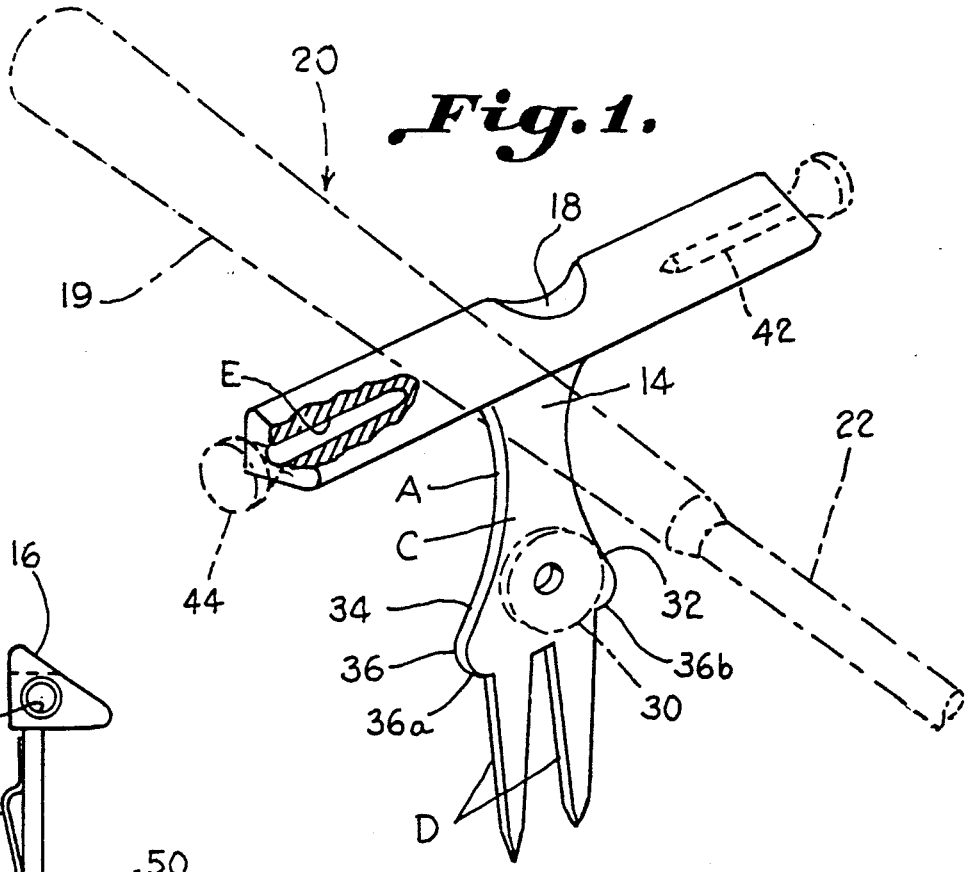
FIG. 1 is a perspective view of a golf accessory device supporting a golf club grip above the ground according to the invention.

Referring now in more detail to the drawings, as can best be seen in FIG. 1, a golf accessory device designated generally as A is disclosed which includes a main body C, lateral arm means B for supporting a grip of a golf club above the ground, and depending prongs D which anchor the device into the ground and provide a divot repair tool. Tee carrying means E is provided in the arm means B for carrying one or more golf tees. Marker carrying means F is provided for carrying a ball marker on the main body.

Figure 3:
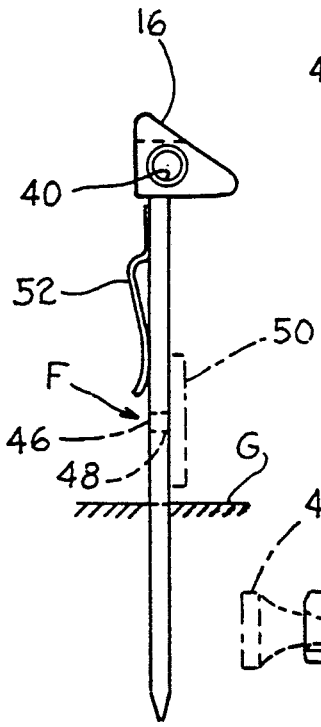
FIG. 3 is a side elevation of a golf accessory device according to the invention.
Figure 2:
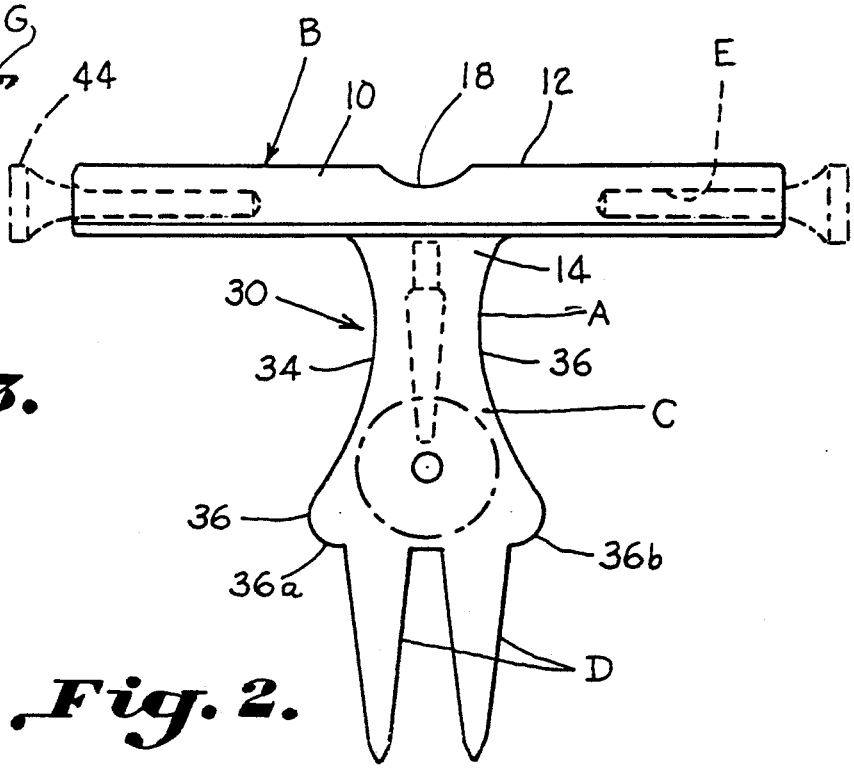
FIG. 2 is a front elevation illustrating a golf accessory device according to the invention.

Lateral arm means B comprises a first lateral arm 10 and a second lateral arm 12 extending from an upper portion 14 of main body C. Lateral arms 10, 12 extend substantially past main body C and include planar grip supporting surfaces 18 for supporting a grip 19 of one or more golf clubs 20 from being wetted by dew or other moisture on the ground. Planar support surfaces 16 are inclined to provide a grip supporting surface which is substantially parallel to a shaft 22 of golf clubs 20 for frictionally retaining the grip on the arm. As can best be seen in FIGS. 1 and 3, inclined planar support surfaces 16 are defined by fastening lateral arms 10, 12 to have a polygonal cross-section such as a triangular cross-section as shown (FIG. 3).

A generally "T"-shaped handle is designated generally as 30 for conveniently inserting prongs D in the ground G for repairing ball marks or divots. Handle 30 includes lateral arms 10, 12 and inwardly curved surfaces 32 and 34 formed on opposing sides of the main body. The contoured handle may be conveniently gripped by the hand of the golfer to force the device into the ground. Separating the inner ends of arms 10 and 12 is a concave support surface 18 which is perpendicular to main body C. When prongs D are inserted in the ground, support surface 18 may be utilized to support cigarettes or other elongated objects. Main body C includes a base 36 having lateral projections **36*a* and 36*b*** which extend past prongs D to provide a widened, stable base against the ground when prongs D are completely inserted, resisting lateral forces imposed by a golf club supported on only one arm. Supporting clubs on each arm has a counterbalancing effect which also stabilizes.

Tee carrying means E comprise bores 40 formed in lateral arms 10 and 12 which receive a shank 42 of a tee 44. Marker carrying means F comprises a bore 46 which receives a stem 48 of ball marker 50. Means for attaching the device to an associated surface may be provided in the form of a conventional clip 52 or other suitable means such as Velcro or the like may be used.

While a preferred embodiment of the invention has been described using specific terms, such description is for illustrative purposes only, and it is to be understood that changes and variations may be made without departing from the spirit or scope of the following claims.

What is claimed is:

1. A golf accessory device which is carried by a golfer comprising:

a main body having first and second ends;

a pair of spaced prongs depending from said main first end of said body for repairing divots and anchoring said main body in the ground;

lateral arm means attached to said second end of said main body extending outwardly past said main body for providing handle means for inserting said device in the ground and for supporting at least one grip of a golf club above the ground said arm means having an inclined planar surface for frictional retention of a said at least one club handle grip when said handle extend substantially parallel to said planar surface; and tee carrying means on said arms for carrying golf tees.

2. The device of claim 1 wherein said arm means comprises a first lateral arm attached to said main body, and a second lateral arm attached to said main body extending in an opposite direction therefrom.

3. The device of claim 2 wherein said tee carrying means comprises a bore formed in said first and second lateral arms for receiving a shank of a golf tee.

4. The device of claim 2 wherein said first and second lateral arms have a polygonal cross-section.

5. The device of claim 4 wherein said cross-section is triangular.

6. The device of claim 1 including marker carrying means on said main body for carrying a ball marker.

7. The device of claim 1 wherein said tee carrying means comprises a bore formed within said lateral arm means for receiving a shank of said tee.

8. The device of claim 1 comprising a clip carried by said main body for attaching said device to a surface.

9. A golf accessory device which is carried by a golfer comprising:

a main body having a first end and a second end, said second end terminating at a base of said main body a pair of lateral arms carried by said first end of said main body and extending outwardly past said main body for supporting the grip portion of golf club handles above the ground;

a concave surface formed between said pair of lateral arms for holding a cigarette and like round article a grip supporting surface on each of said lateral arms for frictionally engaging said grip portion of said golf club handle; and a pair of spaced prongs depending from said second end of said main body and extending substantially perpendicular to said lateral arms for penetrating the ground to locate said main body in an upright position and to provide a stable anchor maintaining said accessory device in an upright manner.

10. The device of claim 9 wherein said first and second arms include an inclined planar support surface providing a surface substantially parallel to the shaft of a golf club for frictional retention of a golf club handle grip.

11. The device of claim 9 wherein said lateral arms lateral arms further comprise handle means.

12. The device of claim 9 wherein said main body and lateral arms present a generally "T"-shaped handle for inserting said prongs in the ground.

13. The device of claim 12 wherein said main body includes inwardly curved surfaces between said first and second ends.

14. The device of claim 9 wherein said base projects laterally with respect to said prongs to provide a widened base surface which contacts the ground with said prongs inserted in said ground.

* * * * *